US007089950B2

(12) United States Patent
Lin et al.

(10) Patent No.: US 7,089,950 B2
(45) Date of Patent: Aug. 15, 2006

(54) UMBRELLA OPERATIVELY CLOSED BY DIRECTLY PULLING RUNNER DOWNWARDLY ALONG A GUIDING SLEEVE

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 78 days.

(21) Appl. No.: 10/945,928

(22) Filed: Sep. 22, 2004

(65) Prior Publication Data

US 2006/0081278 A1 Apr. 20, 2006

(51) Int. Cl.
*A45B 25/08* (2006.01)

(52) U.S. Cl. ..... 135/38; 135/28; 135/41

(58) Field of Classification Search ..... 135/28–31, 135/37–41

See application file for complete search history.

(56) References Cited

U.S. PATENT DOCUMENTS 5,398,709 A * 3/1995 Lee ..... 135/28
5,740,824 A * 4/1998 Tang ..... 135/28
6,371,141 B1 * 4/2002 Lin et al. ..... 135/28
6,571,813 B1 * 6/2003 Lin et al. ..... 135/28
6,758,229 B1 * 7/2004 Wang ..... 135/41
6,941,960 B1 * 9/2005 Huang ..... 135/41

FOREIGN PATENT DOCUMENTS

WO WO 2004/017783 * 3/2004

* cited by examiner

*Primary Examiner*—Winnie Yip
(74) *Attorney, Agent, or Firm*—Troxell Law Office, PLLC

(57) ABSTRACT

An umbrella includes: a central shaft, and a rib assembly respectively pivotally secured to an upper notch formed on a top of the central shaft and to a runner slidably held on a guiding sleeve disposed about the central shaft; with the guiding sleeve integrally formed with a resilient protrusion on the sleeve; and the runner having a socket formed in the runner for engaging the resilient protrusion for opening the umbrella, and a sloping portion inclined upwardly inwardly from the socket for thrusting the resilient protrusion inwardly for disengaging the runner from the resilient protrusion on the guiding sleeve when lowering the runner for closing the umbrella, thereby omitting the lateral depression operation by inwardly depressing a spring catch of a conventional umbrella and thereby enhancing a safe, quick, and ergonomic operation for closing the umbrella.

13 Claims, 6 Drawing Sheets

Fig. 6
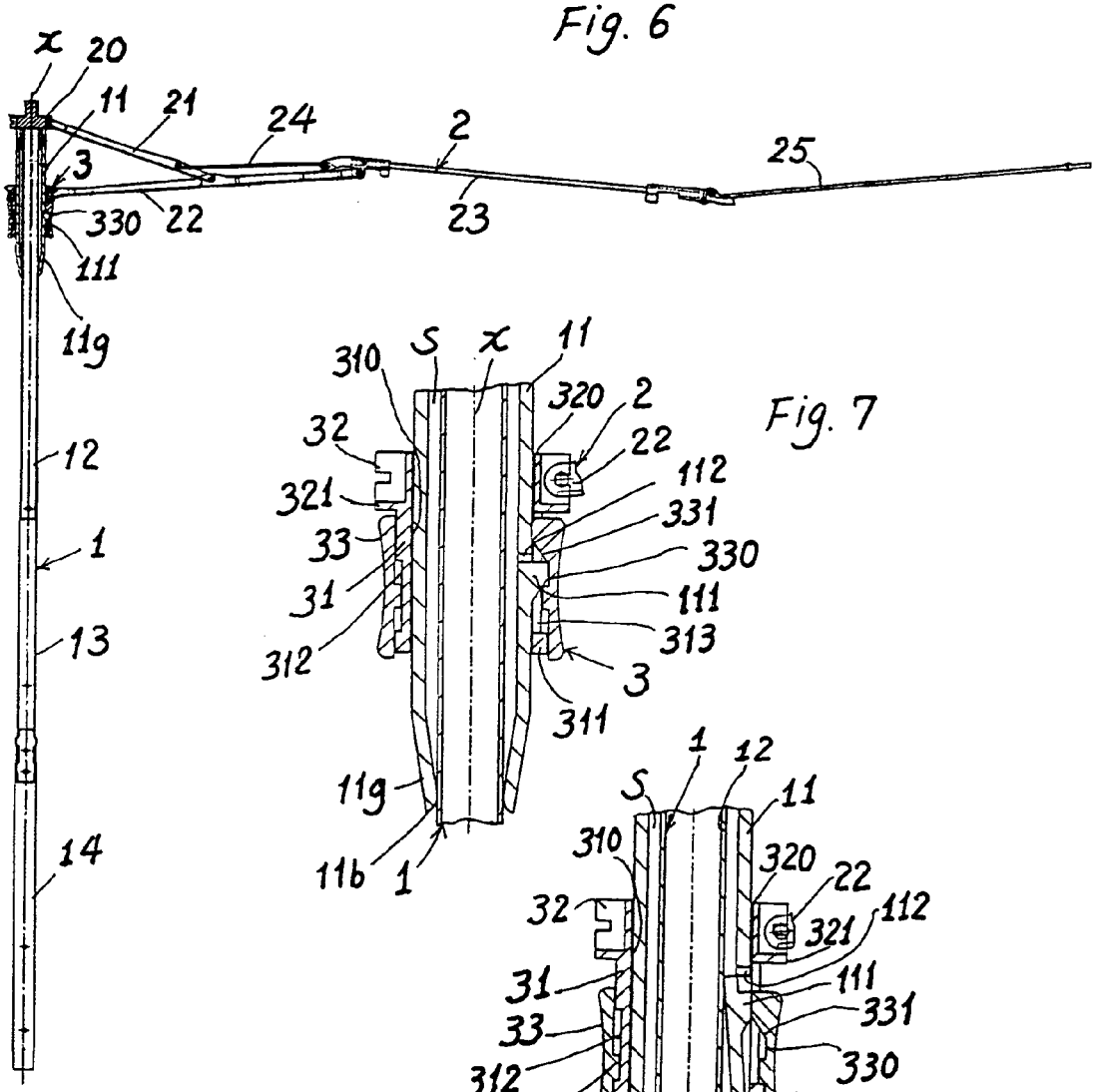
Fig. 7
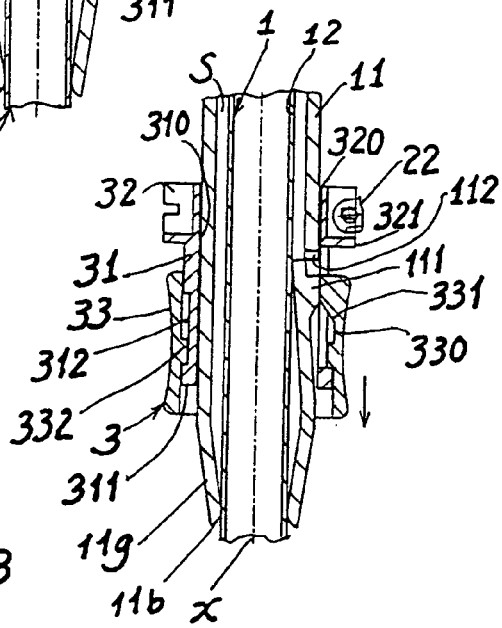
Fig. 8

UMBRELLA OPERATIVELY CLOSED BY DIRECTLY PULLING RUNNER DOWNWARDLY ALONG A GUIDING SLEEVE

BACKGROUND OF THE INVENTION

A prior U.S. patent application entitled "Umbrella Having Safety Runner and Strength-enhanced Shaft Tube" filed on Jul. 22, 2002 with patent application Ser. No. 10/199,171 (which is now allowed) by the same applicant of the present invention provides a safety runner (3) having a shoulder portion (34) engaged with a catch portion (53) of the spring catch (5) secured on the umbrella shaft when opening the umbrella, and upon depression of the push button (4) to disengage the shoulder portion (34) from the catch portion (53), the runner (3) may be lowered for closing the umbrella.

However, when raising the runner (3) for opening the umbrella, the umbrella user (or operator) may always grasp the runner (3) by his or her hand uncarefully to simultaneously depress the push button (4) inwardly, thereby retarding the engagement of the catch portion (53) with the shoulder portion (34) in the runner (3) and thereby being unable to open the umbrella.

The present inventor has found the drawback of the prior art and invented the present umbrella for reliably operating the umbrella.

SUMMARY OF THE INVENTION

The object of the present invention is to provide an umbrella including: a central shaft, and a rib assembly respectively pivotally secured to an upper notch formed on a top of the central shaft and to a runner slidably held on a guiding sleeve disposed about the central shaft; with the guiding sleeve integrally formed with a resilient protrusion on the sleeve; and the runner having a socket formed in the runner for engaging the resilient protrusion for opening the umbrella, and a sloping portion inclined upwardly inwardly from the socket for thrusting the resilient protrusion inwardly for disengaging the runner from the resilient protrusion on the guiding sleeve when lowering the runner for closing the umbrella, thereby omitting the lateral depression operation by inwardly depressing a spring catch of a conventional umbrella and thereby enhancing a safe, quick, and ergonomic operation for closing the umbrella.

BRIEF DESCRIPTION OF THE DRAWINGS

FIG. 6 shows another preferred embodiment of the present invention when opened.

FIG. 7 is a partially enlarged view from FIG. 6.

FIG. 8 shows a step for lowering the runner for closing the umbrella from FIG. 7.

DETAILED DESCRIPTION

Figures 1, 2, 3:
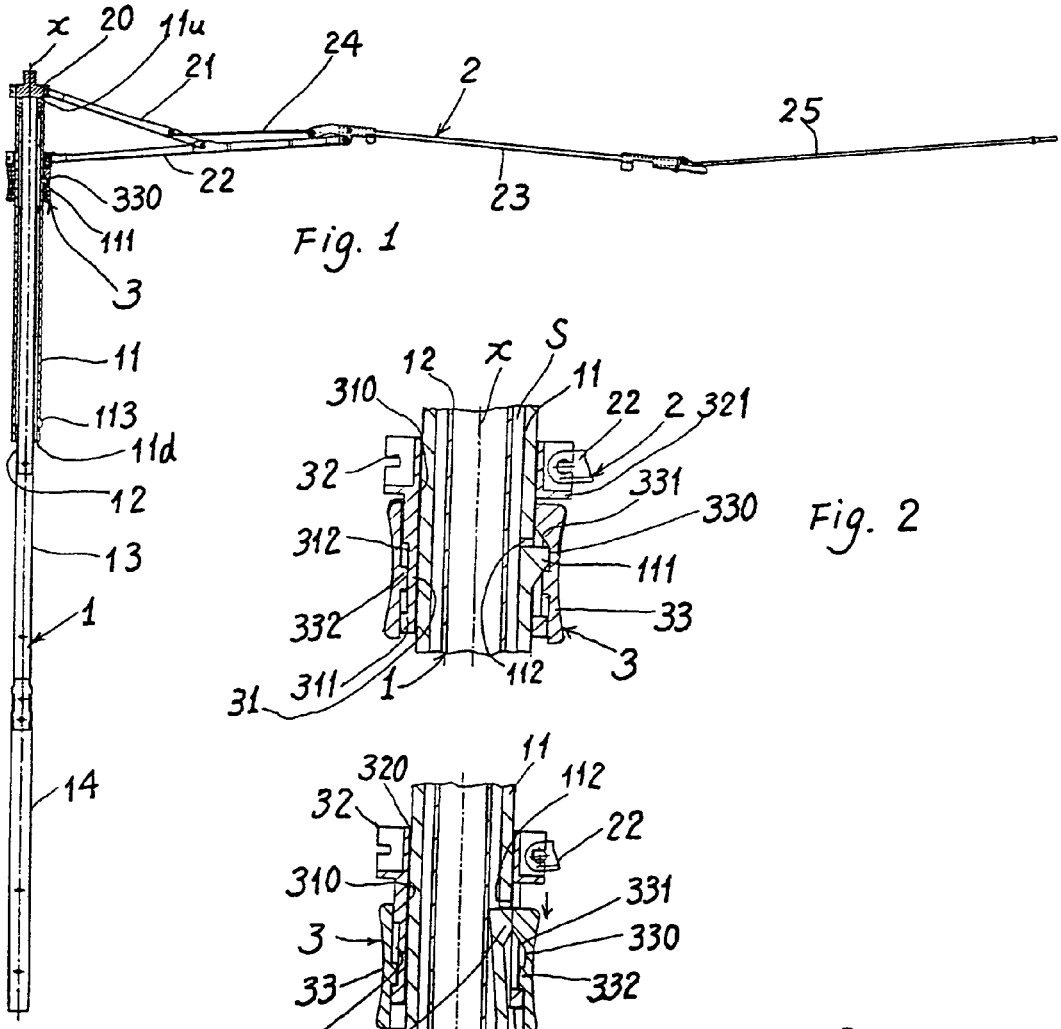
FIG. 1 is an illustration showing an opening umbrella of the present invention.
FIG. 2 is a partial enlarged sectional drawing of FIG. 1 showing the engagement of the runner with the guiding sleeve.
FIG. 3 is a sectional drawing of the present invention showing lowering of the runner for closing the umbrella.

As shown in FIGS. 1~5, the present invention comprises: a central shaft 1, a rib assembly 2 for securing umbrella cloth thereon pivotally secured to a top of the central shaft 1 and a runner (or lower runner) 3. The umbrella may be triple-fold as shown in the drawing figures. However, the number of folds of the umbrella are not limited in the present invention.

The central shaft 1 includes: an upper tube 12, a middle tube 13 and a lower tube 14 telescopically engageable with one another; and a guiding sleeve 11 disposed about the upper tube 12, the middle tube 13 and the lower tube 14 when retracted and folded when closing the umbrella. Both the guiding sleeve 11 and the upper tube 12 have their upper ends secured to an upper notch 20 of the rib assembly 2.

The rib assembly 2 includes: a top rib 21 pivotally secured to the upper notch 20, a stretcher rib 22 having its inner portion pivotally secured to the runner 3 and having a middle portion of the stretcher rib 22 pivotally secured to an outer portion of the top rib 21, an intermediate rib 23 having its inner portion respectively pivotally secured to an outer portion of the stretcher rib 22 and pivotally secured to the top rib 21 by a connecting rib 24, and a tail rib 25 pivotally secured to the intermediate rib 23.

The guiding sleeve 11 and the upper tube 12 define an annular aperture S therebetween for receiving the middle tube 13 and the lower tube 14 into the aperture S when closing the umbrella. The upper end 11*u* of the sleeve 11 is secured to the upper notch 20.

The guiding sleeve 11 may be integrally formed with a resilient protrusion 111 on the sleeve 11 by cutting a slit 112 in the sleeve 11 along a partial contour of the protrusion 111. The resilient protrusion 111 normally protrudes outwardly from a longitudinal axis X of the central shaft 1 to be engaged with a socket 330 recessed in the runner 3. The resilient protrusion 111 may be depressed inwardly into the aperture S between the sleeve 11 and the upper tube 12 when thrusted by the runner 3 such as shown in FIG. 3.

The guiding sleeve 11 may be made of plastic material or other suitable materials. The resilient protrusion 111 has its lower portion formed as a sloping surface to be thrusted inwardly by a central ring 320 of the runner 3 when raising the runner 3 to allow the protrusion 111 to be engaged with the socket 330 of the runner in order for opening the umbrella (such as from FIG. 4 to FIG. 1); and having the upper portion of the resilient protrusion 111 formed as a right-angle or angled portion to be engaged with the socket 330 as recessed in the runner 3 when opening the umbrella.

The runner 3 includes: a cylinder portion 31 having a central opening 310 slidably engageable with the guiding sleeve 11, a ferrule 32 formed on an upper portion of the cylinder portion 31 for pivotally securing the stretcher ribs 22 of the rib assembly 2, and a cylindrical coupling 33 slidably engageable with and disposed about the cylinder portion 31 and having the socket 330 recessed in the cylindrical coupling 33 for engaging the resilient protrusion 111 formed on the guiding sleeve 11 when opening the umbrella.

The ferrule 32 has the central ring 320 disposed around the central opening 310 and slidably engageable with the guiding sleeve 11, whereby when raising the runner 3 for opening the umbrella, the central ring 320 will depress the resilient protrusion 111 inwardly to allow the ferrule 32 to pass the protrusion 111 which will then resiliently protrude outwardly to engage with the socket 330 of the runner 3, thereby locking the runner 3 on the protrusion 111 for stably opening the umbrella.

The cylinder portion 31 is formed with a cylindrical groove 312 for slidably engaging the cylindrical coupling 33 in the cylindrical groove 312, a bottom flange 311 formed on a bottom portion of the cylinder portion 31 for limiting the cylindrical coupling 33 without being downwardly released from the cylinder portion 31, and a slot 313 cut out through the cylinder portion 31 to protrude the resilient protrusion 111 outwardly from the guiding sleeve 11 to be engaged with the socket 330 recessed in the cylindrical coupling 33 of the runner 3 when opening the umbrella (FIG. 2).

The cylindrical coupling 33 includes: an inner extension 332 circumferentially formed on an inside wall of the coupling 33 and slidably engageable with the cylindrical groove 312 of the cylinder portion 31, a socket 330 recessed in the coupling 33 between the inner extension 332 and a sloping portion 331 inclined upwardly inwardly towards a longitudinal axis X of the central shaft 1 for thrusting the resilient protrusion 111 inwardly for disengaging the socket 330 from the resilient protrusion 111 when lowering the runner 3 for closing the umbrella (from FIG. 2 to FIG. 3); with the inner extension 332 downwardly limited by the bottom flange 311 of the cylinder portion 31 (FIG. 3) to prevent from separation of the cylindrical coupling 33 from the cylinder portion 31 of the runner 3 when lowered for closing the umbrella.

Figure 4:
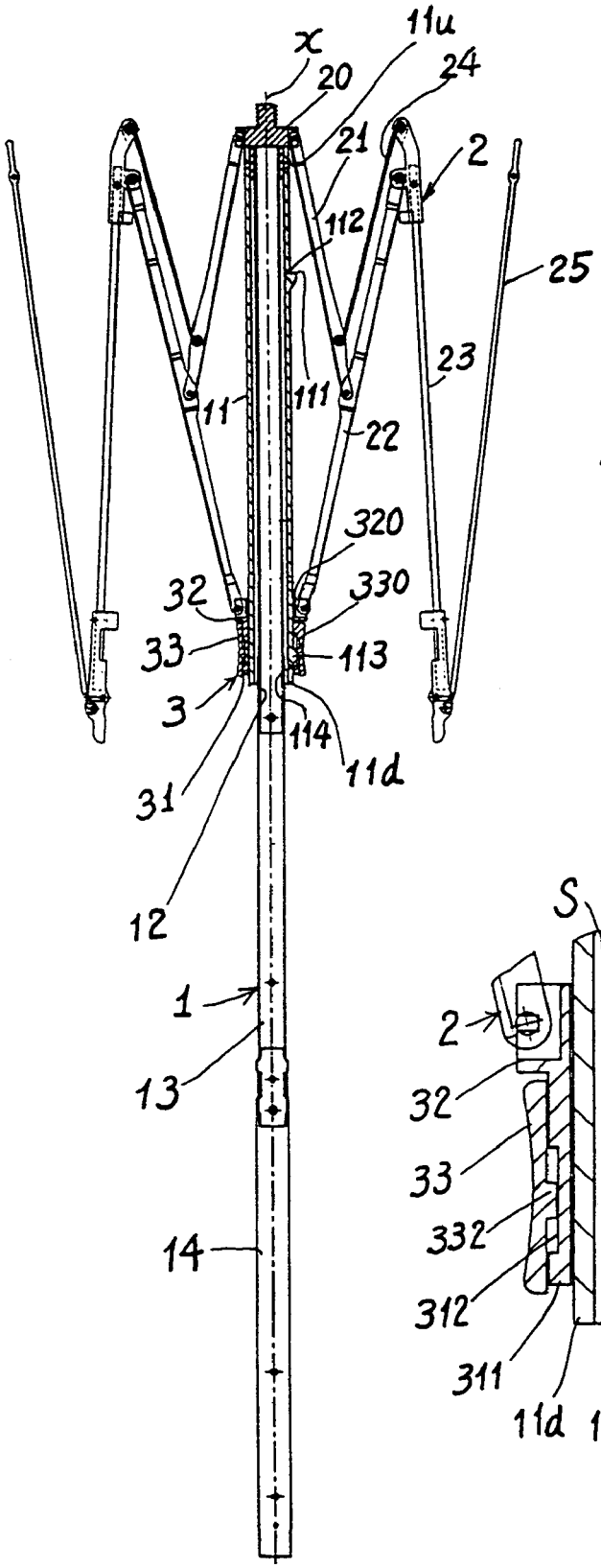
FIG. 4 shows a closed umbrella having the rib assembly folded, and having a lower resilient protrusion formed on the guiding sleeve for engaging the runner when closing the umbrella.
Figure 5:
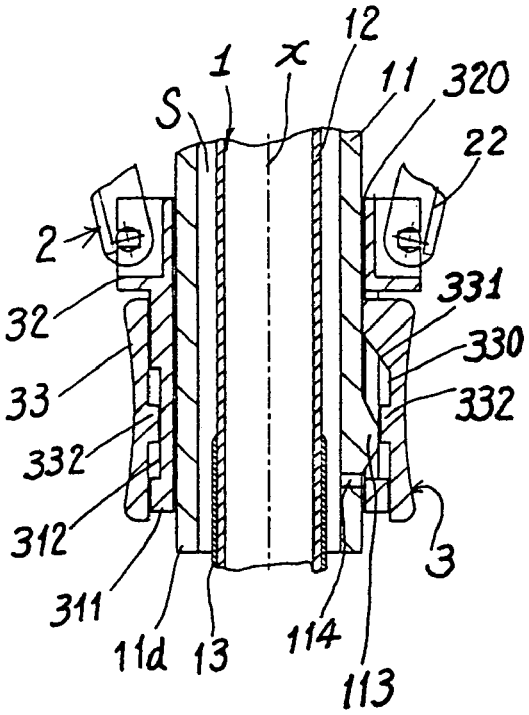
FIG. 5 shows the engagement of the runner with the lower protrusion of the sleeve as enlarged from FIG. 4.

The guiding sleeve 11 has a length approximating a length of each tube of the shaft such as the length of upper tube 12, having a lower resilient protrusion 113 formed on a lower portion of the guiding sleeve 11 for engaging the inner extension 332 formed in the coupling 33 when lowering the runner 3 for closing the umbrella as shown in FIGS. 4, 5.

For simplifying purpose, the lower resilient protrusion 113 may be omitted in the present invention, not limited in the present invention.

The lower resilient protrusion 113 is also integrally formed on the guiding sleeve 11 by cutting a slit 114 in the sleeve 11 along a contour of the lower protrusion 113.

When closing the umbrella, the middle tube 13 and the lower tube 14 are retracted and received into the slot S between the guiding sleeve 11 and the upper tube 12.

As shown in FIG. 6~12, another preferred embodiment of the present invention is disclosed by shortening the guiding sleeve 11 as aforementioned.

Figure 9:
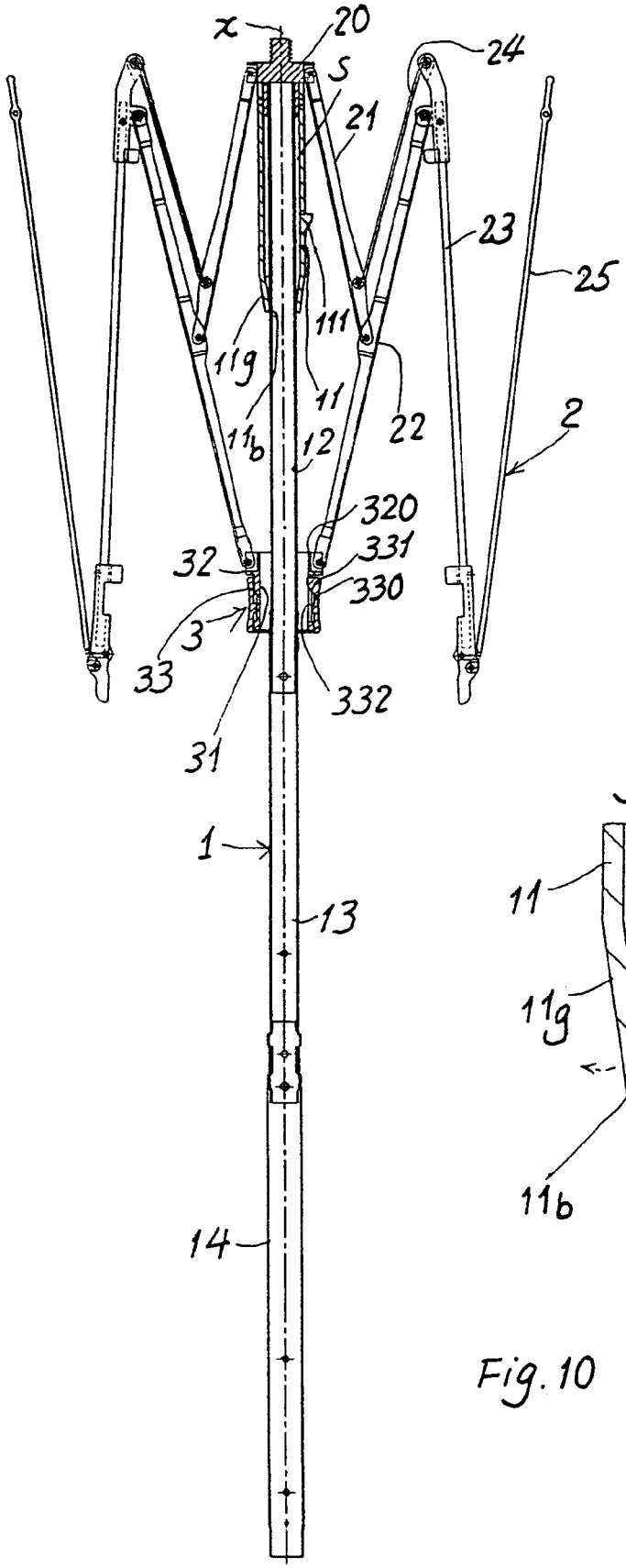
FIG. 9 shows a closed umbrella by folding the rib assembly from FIG. 6.

The shortened guiding sleeve 11 as shown in FIG. 6 has a length which is enough to allow the resilient protrusion 111 formed on the sleeve 11 to engage with the socket 330 in the runner 3 for opening the umbrella, having a lower guiding portion 11*g* formed on a lower portion of the guiding sleeve 11 and tapered downwardly towards the longitudinal axis X for smoothly passing the runner 3 over the guiding portion 11*g* in order to be engaged with the protrusion 111 when raising the runner 3 for opening the umbrella as from FIG. 9 to FIG. 6.

Figure 10:
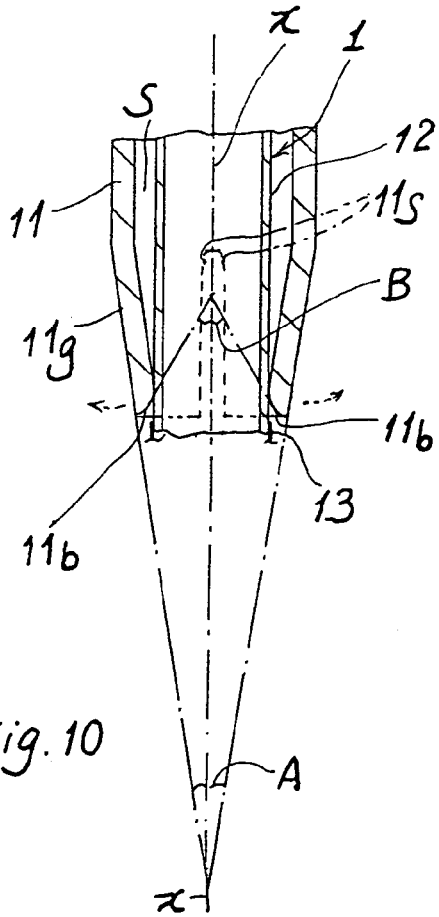
FIG. 10 shows the structure of a lower guiding portion of the guiding sleeve of the embodiment of FIG. 6.
Figure 11:
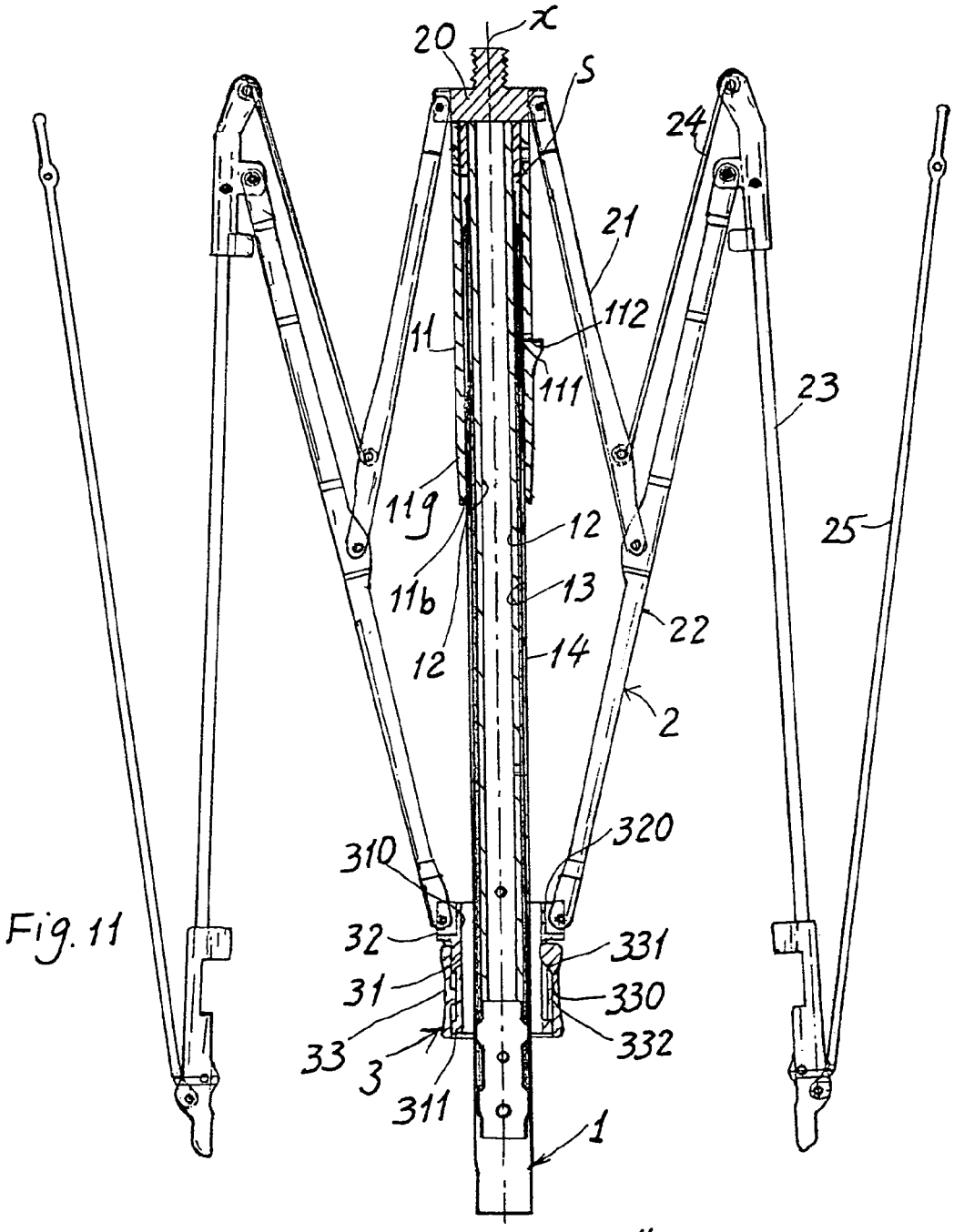
FIG. 11 shows a closed umbrella by retracting the tubes of the central shaft from FIG. 9.
Figure 12:
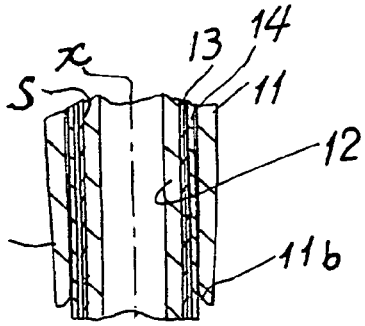
FIG. 12 is a partially enlarged view from FIG. 11.

As shown in FIG. 10, the lower guiding portion 11*g* formed on the guiding sleeve 11 is tapered downwardly to extrapolatively intersect with the longitudinal axis X with a first acute angle A for smoothly guiding the runner 3 when raised for opening the umbrella; and having a tapered bottom rim 11*b* formed on a bottom of the guiding sleeve 11 tapered upwardly to extrapolatively intersect with the longitudinal axis X with a second acute angle B, with the bottom rim 11*b* approximating or resiliently contacting an outer tubular surface of the upper tube 12 and having a plurality of cutting slits 11*s* cut out in the lower guiding portion 11*g*, whereby upon retraction of the middle tube 13 and the lower tube 14 into the slot S between the upper tube 12 and the guiding sleeve 11, the tube 13 or 14 will be smoothly guided by the tapered bottom rim 11*b* to be received into the slot S by slightly expanding the lower guiding portion 11*g* of the guiding sleeve 11 to act like a "chuck" due to the forming of the plural cutting slits 11*s* (FIG. 11, 12).

When closing the umbrella from FIGS. 6 and 7 to FIG. 8, the runner 3 is lowered to disengage the socket 330 from the resilient protrusion 111 to retract the rib assembly 2 towards the shaft 1 (FIG. 9). After retracting the tubes 13, 14 into the slot S (FIG. 11), the umbrella will then be completely folded.

When raising the runner 3 for opening the umbrella even fully grasping the coupling 33, the runner 3 will be no doubt reliably engaged with the protrusion 111 for stably opening the umbrella, thereby overcoming the drawback of a conventional umbrella provided with a push-button type runner.

When closing the umbrella, just by lowering the runner 3, the umbrella can be quickly ergonomically closed without requiring any depression operation such as by a lateral push-button action for disengaging the runner from a spring catch as resiliently formed in the shaft of a conventional umbrella. The resilient protrusion 111 is directly integrally formed on the guiding sleeve 11 for simplifying its production and lowering the cost.

Figure 13:
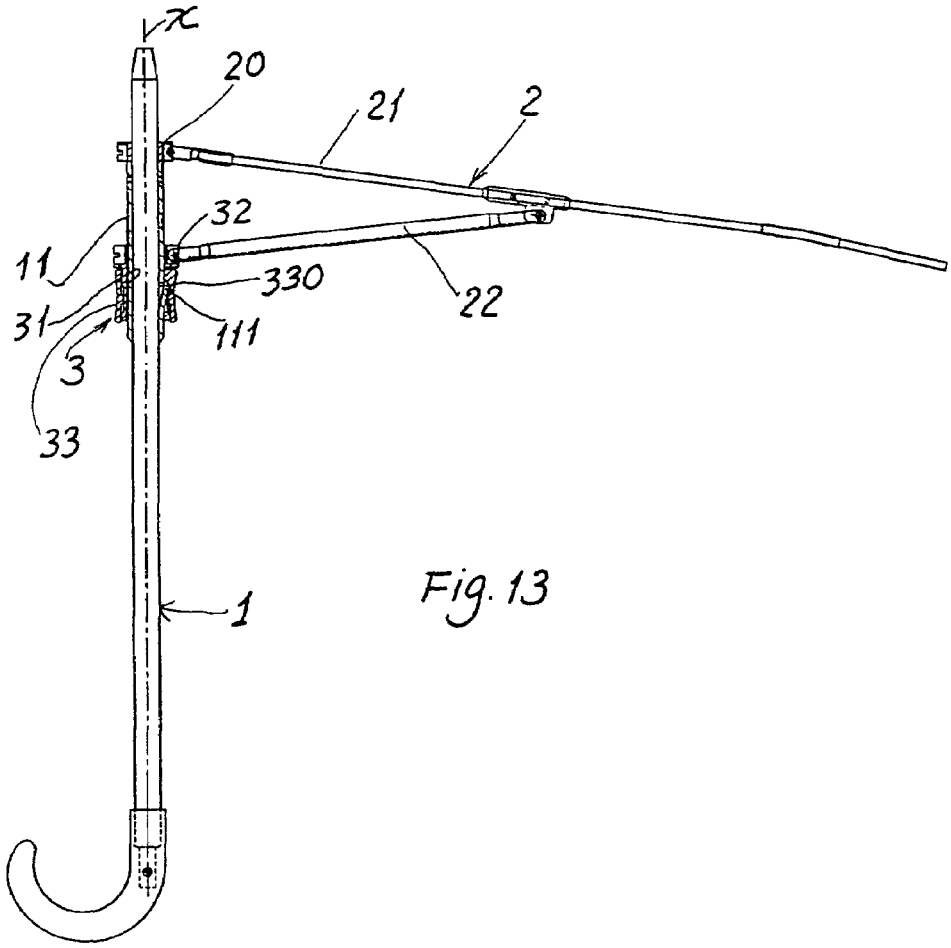
FIG. 13 shows still another preferred embodiment of the present invention when opened.

As shown in FIG. 13, the central shaft 1 is modified to be a single central post or central tube and the shortened guiding sleeve 11 is directly disposed around the central tube; while the rib assembly 2 is also modified to be a single fold rib assembly having a top rib 21 pivotally secured to the upper notch 20 and a stretcher rib 22 pivotally secured to the runner 3 and secured to the top rib 21. When the resilient protrusion 111 is engaged with the socket 330 in the runner 3, the umbrella will be stably opened as shown in FIG. 13. A lower resilient protrusion (not shown) may also be added on a lower portion of the central shaft 1 for engaging the runner 3 when lowered for closing the umbrella.

Conclusively, the conventional "spring catch" as resiliently formed in the central shaft for locking the runner has been eliminated. The resilient protrusion 111 is integrally formed on the guiding sleeve 11 disposed around the tubes of the shaft 1 of this invention for ergonomically disengaging or engaging the runner when closing or opening the umbrella. The tubes of the central shaft 1 of this invention are no longer cut with any slots for protruding the conventional "spring catch" outwardly for engaging the runner when opening the umbrella. The tubes 12, 13, 14 of the central shaft 1 may thus be made thinner. The difference between the tubes is also reduced. Therefore, the present invention may be provided for making a multiple-fold umbrella even with six folds, seven folds, etc.

The present invention may be modified without departing from the spirit and scope of the present invention.

We claim:

1. An umbrella comprising:

a central shaft defining a longitudinal axis in said shaft; and a rib assembly pivotally secured to the central shaft and pivotally secured to a runner;

said central shaft having a guiding sleeve secured to an upper notch on a top of said shaft and disposed around said central shaft for slidably engaging said runner on said sleeve; said guiding sleeve having a resilient protrusion formed on said sleeve;

said runner having a socket recessed in said runner and a sloping portion inclined upwardly from said socket towards said longitudinal axis in said shaft;

whereby upon engagement of said resilient protrusion on said sleeve with said socket in said runner, said runner will be stably engaged on said guiding sleeve for opening the umbrella;

and upon downward pulling of said runner to allow said sloping portion in said runner to thrust said resilient protrusion inwardly towards said axis to disengage said socket of said runner from said protrusion on said sleeve, said runner will be lowered for closing the umbrella.

2. An umbrella according to claim 1, wherein said central shaft includes an upper tube, a middle tube and a lower tube telescopically engaged with one another; and said guiding sleeve disposed around said upper tube and defining a slot between said upper tube and said guiding sleeve for retracting and receiving said middle tube and said lower tube into said slot between said upper tube and said guiding sleeve.

3. An umbrella according to claim 1, wherein said resilient protrusion is integrally formed on said guiding sleeve by cutting a slit along a partial contour of said resilient protrusion to protrude said protrusion outwardly from said longitudinal axis for engaging said socket in said runner for opening the umbrella.

4. An umbrella according to claim 1, wherein said runner includes:

a cylinder portion having a central opening slidably engageable with the guiding sleeve of the shaft, a ferrule formed on an upper portion of the cylinder portion for pivotally securing a stretcher rib of the rib assembly, and a cylindrical coupling slidably engageable with and disposed about the cylinder portion and having said socket recessed in the cylindrical coupling for engaging the resilient protrusion formed on the guiding sleeve when opening the umbrella.

5. An umbrella according to claim 4, wherein said ferrule has the central ring disposed around the central opening and slidably engageable with the guiding sleeve, whereby when raising the runner for opening the umbrella, the central ring will depress the resilient protrusion inwardly to allow the ferrule to pass the protrusion which will then resiliently protrude outwardly to engage with the socket of the runner for locking the runner on the protrusion for stably opening the umbrella.

6. An umbrella according to claim 4, wherein said cylinder portion is formed with a cylindrical groove for slidably engaging the cylindrical coupling in the cylindrical groove, a bottom flange formed on a bottom portion of the cylinder portion for limiting the cylindrical coupling without being downwardly released from the cylinder portion, and a slot cut out through the cylinder portion to protrude the resilient protrusion outwardly from the guiding sleeve to be engaged with the socket recessed in the cylindrical coupling of the runner when opening the umbrella.

7. An umbrella according to claim 4, wherein said cylindrical coupling includes: an inner extension circumferentially formed on an inside wall of the coupling and slidably engageable with a cylindrical groove of the cylinder portion, said socket recessed in the coupling between the inner extension and a sloping portion inclined upwardly inwardly towards a longitudinal axis of the central shaft for thrusting the resilient protrusion inwardly for disengaging the socket from the resilient protrusion when lowering the runner for closing the umbrella.

8. An umbrella according to claim 1, wherein said guiding sleeve has a length approximating a length of each tube of a plurality of tubes telescopically engaged for forming the shaft, having a lower resilient protrusion formed on a lower portion of the guiding sleeve for engaging the runner when lowered for closing the umbrella.

9. An umbrella according to claim 8, wherein said lower resilient protrusion is integrally formed on a lower portion of said guiding sleeve by cutting a slit along a partial contour of said lower resilient protrusion on said guiding sleeve to protrude the lower resilient protrusion outwardly for engaging said runner when lowered for closing the umbrella.

10. An umbrella according to claim 1, wherein said guiding sleeve has a length from the upper notch on said shaft adapted for forming the resilient protrusion on said sleeve for engaging said runner when opening the umbrella, having a lower guiding portion protruding downwardly from said resilient protrusion for retracting a middle tube and a lower tube of said central shaft into a slot between said guiding sleeve and an upper tube of said central shaft when closing the umbrella.

11. An umbrella according to claim 10, wherein said lower guiding portion of said guiding sleeve is tapered downwardly to approximate said upper tube to extrapolatively intersect with the longitudinal axis of said shaft with a first acute angle for smoothly guiding the runner when raised for opening the umbrella.

12. An umbrella according to claim 10, wherein said guiding sleeve has a tapered bottom rim formed on a bottom of the guiding sleeve tapered upwardly to extrapolatively intersect with a longitudinal axis of said shaft with a second acute angle, with the bottom rim contacting an outer tubular surface of the upper tube and having a plurality of cutting slits cut out in a lower guiding portion of said guiding sleeve, whereby upon retraction of the middle tube and the lower tube into the slot between the upper tube and the guiding sleeve, the middle or lower tube will be smoothly guided by the tapered bottom rim to be received into the slot by slightly expanding the lower guiding portion of the guiding sleeve.

13. An umbrella according to claim 1, wherein said shaft and said rib assembly are formed to be a single-fold umbrella or a multiple-fold umbrella.

* * * * *